US005832096A

United States Patent [19]

Hall

[11] Patent Number: 5,832,096

[45] Date of Patent: Nov. 3, 1998

[54] SPEAKER CONTAINING DUAL COIL

[75] Inventor: David S. Hall, Los Altos Hills, Calif.

[73] Assignee: Velodyne Acoustics, Inc., San Jose, Calif.

[21] Appl. No.: 923,468

[22] Filed: Sep. 4, 1997

Related U.S. Application Data

[63] Continuation of Ser. No. 669,647, Jun. 24, 1996, abandoned, which is a continuation of Ser. No. 368,699, Jan. 3, 1995, abandoned, which is a continuation of Ser. No. 1,002, Jan. 6, 1993, abandoned.

[51] Int. Cl.[6] ..... H04R 25/00

[52] U.S. Cl. ..... 381/194; 381/195; 381/197

[58] Field of Search ..... 381/194, 195, 381/192, 199, 204, 197, 202

[56] References Cited

U.S. PATENT DOCUMENTS

| | | | |
|---|---|---|---|
| 1,814,119 | 7/1931 | Bradbury . | |
| 1,830,402 | 11/1931 | Miessner . | |
| 1,955,248 | 4/1934 | Messick . | |
| 1,976,874 | 10/1934 | Brzeski . | |
| 2,030,574 | 2/1936 | Dull . | |
| 2,039,856 | 5/1936 | Taber | 381/197 |
| 2,623,127 | 12/1952 | Dreisbach et al. . | |
| 2,770,681 | 11/1956 | Perry . | |
| 3,033,945 | 5/1962 | Villchur | 381/194 |
| 3,073,899 | 1/1963 | Farnsworth, III . | |
| 3,196,211 | 7/1965 | Kessenich . | |
| 3,496,307 | 2/1970 | Sotoma | 381/202 |
| 3,619,673 | 11/1971 | Helms . | |
| 3,819,876 | 6/1974 | Kinoshita | 381/194 |
| 3,935,402 | 1/1976 | Gersten . | |
| 4,163,876 | 8/1979 | Ohnuki | 381/194 |
| 4,220,832 | 9/1980 | Nagel | 381/195 |
| 4,243,839 | 1/1981 | Takahashi et al. . | |
| 4,259,550 | 3/1981 | Nakamatsu | 381/194 |
| 4,373,607 | 2/1983 | Miller | 181/166 |
| 4,573,189 | 2/1986 | Hall | 381/199 |
| 4,933,975 | 6/1990 | Button | 381/194 |
| 5,243,662 | 9/1993 | Sogn et al. | 381/201 |
| 5,295,194 | 3/1994 | Christensen | 381/192 |

FOREIGN PATENT DOCUMENTS

| | | | |
|---|---|---|---|
| 892396 | 1/1944 | France . | |
| 0892396 | 4/1944 | France | 381/195 |
| 2304238 | 10/1976 | France | 381/204 |
| 65-0025265 | 2/1980 | Japan | 381/195 |
| 66-0008997 | 1/1981 | Japan | 381/194 |
| 66-008997 | 1/1987 | Japan | 381/194 |
| 8102501 | 9/1981 | WIPO | 381/199 |
| 8800424 | 1/1988 | WIPO | 381/194 |

OTHER PUBLICATIONS

"Bobbin for Voice Coils", Jan. 1988.

*Primary Examiner*—Sinh Tran
*Attorney, Agent, or Firm*—Bielen, Peterson & Lampe

[57] ABSTRACT

A loudspeaker including a voice coil and a counter coil connected in series to receive speaker signals. The counter coil is wrapped on the pole pieces in an opposite direction to the voice coil such that a first magnetic field generated by the voice coil is reduced by a second magnetic field generated by the counter coil. In addition, a stiffened and/or elongated voice coil support is provided to reduce distortion caused by a bowing effect of the voice coil due to a warped stationary magnetic field located in the air gap. An acoustically-transparent basket is also provided which minimizes reflected sound waves to further reduce distortion.

7 Claims, 18 Drawing Sheets

SPEAKER CONTAINING DUAL COIL

This is a continuation of application Ser. No. 08/669,647, filed 24 Jun., 1996 now abandoned which is a continuation of application Ser. No. 08/368,699, filed 3 Jan., 1995 now abandoned which is a continuation of application Ser. No. 08/001,002, filed 6 Jan., 1993 abandoned.

FIELD OF THE INVENTION

This invention relates to sound reproduction. More particularly, this invention relates to high fidelity loudspeaker systems capable of reproducing sound signals over a wide range of frequencies.

BACKGROUND OF THE INVENTION

FIG. 12A illustrates a typical prior art "two-way" loudspeaker system including an amplifier 1210 and two speaker boxes 1220. Modern two-way high fidelity speaker systems typically utilize two loudspeakers 1221, 1222 per speaker box 1220 for producing sounds in two different frequency ranges. The two loudspeakers shown in FIG. 12A are a tweeter 1221 for very high frequencies, typically in the range of 2500 to 20,000 Hz, and a midrange loudspeaker 1222 for low frequencies, typically in the range of 700 to 2500 Hz. Tweeter 1221 and midrange speaker 1222 are connected to a crossover network 1230. Crossover network 1230 receives an output signal from amplifier 1210 and separates the output signal into two signals, one of which is transmitted to tweeter 1221 and the other of which is transmitted to midrange speaker 1222.

A modern "three-way" speaker system differs from the two-way system of FIG. 12A in that a third loudspeaker, known as a "woofer" (not shown), is included in each speaker box. The woofer is used to produce sounds having very low frequencies, typically in the range of 50 to 700 Hz.

FIGS. 12B and 12C are more detailed representations of a typical prior art loudspeaker 1240. FIG. 12B is a back view of loudspeaker 1240 and FIG. 12C is a section side view (not to scale) taken along section line 12C—12C of FIG. 12B. Loudspeaker 1240 includes a steel base or bottom plate 1245 and a doughnut-shaped cylindrical magnet 1250 connected at a first surface 1290 to bottom plate 1245. A central bore 1251 extends through magnet 1250 along an axis 1254. A cylindrical steel central pole piece 1255 is connected to bottom plate 1245 and disposed concentrically within central bore 1251 such that central pole piece 1255 is separated from magnet 1250.

A steel top plate, sometimes referred to an outer pole piece 1260, is concentrically disposed on a second surface 1291 of the magnet 1250 and includes a hole having an inner surface 1262 disposed adjacent an outer surface 1256 of central pole piece 1255 such that central pole piece 1255 and outer pole piece 1260 are separated by an narrow air gap 1265. A width of air gap 1265 is the perpendicular distance W1266 between inner surface 1262 of outer pole piece 1260 and outer surface 1256 of central pole piece 1255 (measured in a direction radial to axis 1254). A length of air gap 1265 is determined by thickness T1263 of the outer pole piece 1260 facing innersurface 1262 of central pole piece 1260 (measured along the axis 1254).

A bowl-shaped basket 1270 is connected at its lower end 1271 to outer pole piece 1260 and includes a plurality of arms 1272, which are connected between lower end 1271 and an outer rim 1273. Arms 1272 are typically aluminum or steel plates formed with a width W (FIG. 12B) which is substantially larger than a thickness T (FIG. 12C). Openings 1274 are formed between arms 1272.

A thin-walled, cylindrical voice coil support 1275 is connected to basket 1270 by a spider 1280 such that a first end 1276 of voice coil support 1275 is disposed in air gap 1265. A voice coil 1277 is connected to voice coil support 1275 at first end 1276. Finally, a cone 1285 is connected at an inner edge 1286 to a second end 1278 of voice coil support 1275 and at its outer edge 1287 to rim 1273 of basket 1270. Prior art loudspeakers are typically constructed with width W of arms 1272 (FIG. 12B) facing cone 1285.

FIGS. 13A through 13C are provided to illustrate the operation of loudspeaker 1240.

FIG. 13A illustrates the magnetic field produced by magnet 1250. The magnetic flux lines 1310 depict the magnetic field which is generated in a portion of loudspeaker 1240 made up of bottom plate 1245, magnet 1250, outer pole piece 1260 and central pole piece 1255. Flux lines 1310 produce a "stationary" magnetic field across air gap 1265. It is commonly understood that the strength of the stationary magnetic field is inversely proportional to width W1266 of air gap 1265.

FIG. 13B illustrates an enlarged view of the air gap 1265. In FIG. 13B, the stationary magnetic field across air gap 1265 is depicted by ideal flux lines 1311. Ideal flux lines 1311 are drawn as straight flux lines disposed perpendicular to inner surface 1262 of outer pole piece 1260 and outer surface 1256 of central pole piece 1255. When a speaker signal is transmitted through voice coil 1277 of a loudspeaker having an ideal stationary magnetic field represented by ideal flux lines 1311, an axial driving force $F_A$ is generated which acts on voice coil 1277 in a direction parallel to the axis 1254, FIG. 12C. Axial driving force $F_A$ is directly proportional (i) to the strength of the stationary magnetic field and (ii) to the amplitude of the speaker signal. Axial driving force $F_A$ accelerates voice coil 1277 away from cone 1285, thereby causing cone 1285 to vibrate and produce desired sounds related to the frequency and amplitude of driving force $F_A$.

FIG. 13C illustrates an enlarged view of air gap 1265 in which a stationary magnetic field is illustrated which more closely represents an actual stationary magnetic field produced in a prior art loudspeaker. The actual stationary magnetic field is depicted by air gap flux lines 1320 and edge flux lines 1322. In actual operation, voice coil 1277 produces a voice coil magnetic field, depicted by voice coil flux line 1330, which is directly proportional to the amplitude of an applied speaker signal. The voice coil magnetic field affects the stationary magnetic field across the air gap 1265 in two ways. First, the voice coil magnetic field weakens the stationary magnetic field by an amount directly proportional to the amplitude of the speaker signal. As the speaker signal increases and decreases in amplitude, the voice coil magnetic field modulates the stationary magnetic field, which in turn modulates driving force $F_A$, causing distortion due to the inconsistent movement of the voice coil 1277.

A second effect of the voice coil magnetic field is that the voice coil magnetic field warps the stationary magnetic field such that the actual air gap flux lines 1320 are bent (non-uniform) as shown in FIG. 13C. In addition, the edge flux lines 1322 are bent by the geometry of the surfaces located at the edges of air gap 1265. The resultant force F acting on the voice coil 1275 by the bent air gap flux lines 1320 and the edge flux lines 1322 includes both an axial force component $F_A$ and a radial force component $F_R$. The radial force component $F_R$ acts on the voice coil by causing the voice coil 1277 to "bow" outward. This bowing effect results in radial vibrations which deform the voice coil support 1275, the vibrations being transmitted to the cone 1285 to produce distortion (unwanted noise).

A first solution to the problem of distortion caused by the voice coil magnetic field in prior art loudspeakers was to reduce the width of air gap 1265 to strengthen stationary magnetic field. However, even if the width of air gap 1265 was minimized, the stationary magnetic field was warped when high amplitude speaker signals were transmitted through voice coil 1275. Because of the modern trend toward loudspeakers which can handle high amplitude speaker signals, the distortion caused by the voice coil magnetic field was not significantly reduced by efforts to narrow the air gap 1265.

Another solution to the problem of distortion caused by the voice coil magnetic field was to employ a lightweight voice coil support. This solution presupposed that, with a lightweight voice coil support, less force was necessary to drive the loudspeaker, thereby reducing the required amplitude of the speaker signal. By reducing the required amplitude, the modulation caused by the voice coil magnetic field was also reduced. Therefore, prior art voice coil supports were typically produced from Kapton or aluminum which is approximately two to five mils thick and were formed with a diameter to length ratio greater than unity.

Another method of reducing distortion caused by the voice coil magnetic field is taught in U.S. Pat. No. 4,243,839 (the "Takahashi patent"), which is incorporated herein by reference in its entirety. The Takahashi patent teaches a transducer disposed near the air gap for generating a current in response to the voice coil magnetic field. The current was applied through an amplifier to a feedback coil which generated a magnetic field which was opposed to the voice coil magnetic field. A problem with the structure taught in the Takahashi patent is that, although the weakness of the stationary magnetic field is to some extent avoided, the bowing effect of the voice coil is not significantly diminished. Therefore, a loudspeaker constructed in accordance with the Takahashi patent does not exhibit significantly improved performance over the loudspeaker 1240, described above.

French Patent No. 892,396 to M. Cesati, "Systeme Electrodynamique, specialement pour hauts-parleurs", teaches a two-coil structure including a moving (voice) coil, disposed in the air gap as described above, and fixed coils disposed on the pole pieces in the air gap. The fixed coils are wired in series with the voice coil, but in an opposite sense to produce a counter impedance; that is, a current travels through the windings of the fixed and moving coils in opposite directions. French Patent No. 892,396 teaches that the voice coil impedance increases in direct relation to the frequency of the speaker signal. By introducing a fixed coil having an equal but opposite impedance, the voice coil impedance is effectively eliminated. At the time of publication of French Patent No. 892,396, the available amplifiers were inherently weak. Therefore, even a small increase in the load on the amplifiers caused a significant reduction in performance. The purpose of the fixed coils was to stabilize the load on the amplifier which occurred at high frequencies.

FIG. 14 shows a portion of a loudspeaker including the fixed coils according to French Patent No. 892,396. The loudspeaker 1400 includes an outer core piece 1410 upon which is disposed a first fixed coil 1415, an inner core piece 1420 upon which is disposed a second fixed coil 1425, and a moving coil 1430. Speaker signals are applied to the loudspeaker 1400 from first and second terminals 1440 and 1441. A first lead 1442 is connected between the first terminal 1440 and the first fixed coil 1415. A second lead 1443 is connected between the first fixed coil 1415 and the moving coil 1430. A third lead 1444 is connected between the moving coil 1430 and the second fixed coil 1425. Finally, a fourth lead 1445 is connected between the second fixed coil 1425 and the second terminal 1441. Note that the first fixed coil 1415 and the second fixed coil 1425 are wound in a common direction (e.g., clockwise) which is opposite to the winding direction of the moving coil 1430.

With the fixed and moving coils connected as described in French Patent No. 892,396, the inductance generated by the moving coil 1430 is countered by the inductance generated by the first and second fixed coils 1415 and 1425. This reduces the load on an amplifier applying signals to terminals 1440 and 1441.

It is believed that after high powered amplifiers became available, the fixed coils taught in French Patent No. 892,396 were not commercially implemented because the higher powered amplifiers were not significantly affected by the voice coil inductance. Further, a widened air gap is necessary to implement the counter coils which conflicts with the generally-held belief that narrow air gaps are necessary for a strong stationary magnetic field. That is, the air gap (distance between the pole pieces) must be widened to make room for the fixed coils. The widened air gap is generally believed to weaken the stationary magnetic field, which results in driving force modulation. Further, a loudspeaker incorporating the fixed coils of the French Patent No. 892,396 would have a problem operating at high amplitudes due to distortion caused by the voice coil bowing effect.

SUMMARY OF THE INVENTION

The present invention is directed to an apparatus and a method that satisfy the need for a high-quality loudspeaker which reduces distortion caused by the modulation of the voice coil driving force and the voice coil bowing effect.

A loudspeaker according to one embodiment of this invention includes a counter coil disposed on the pole pieces within the air gap. The counter coil is connected in series with the voice coil and formed to produce a counter magnetic field which reduces the effect of the voice coil magnetic field on the stationary magnetic field, thereby reducing modulation of the stationary magnetic field by the voice coil magnetic field when subjected to the high amplitude speaker signals generated by modern amplifiers.

Another embodiment in accordance with the present invention includes a stiffened or elongated or stiffened and elongated voice coil support (herein referred to a "stiffened/elongated voice coil support") provided to counter vibrations of the voice coil support due to the bowing effect caused by non-uniform stationary magnetic field flux lines. The stiffened/elongated voice coil support absorbs the radial force component exerted on the voice coil support by the bowing effect. The voice coil support in the embodiment has a diameter-to-length ratio in the range of 1:1 to 1:3. Relative to prior art speaker voice coil supports, the voice coil support of this invention is heavier and so tends to reduce voice coil sensitivity to low level signals. However, the important aspect is that the loudspeaker can be driven at a higher amplitudes than prior art speakers without distortion due to the implementation of the counter coil. Thus, a loudspeaker incorporating the counter coil and stiffened/elongated voice coil support provides superior sound quality over all prior art loudspeaker designs.

Further, in accordance with another embodiment of the present invention, a recess is formed in the central pole piece adjacent the air gap to reduce the radial force component disposed adjacent the edges of the air gap. The recess decreases the magnetic attraction between the non-parallel portions of the central pole piece and the outer pole piece, thereby weakening the warped flux lines located near the edges of the air gap relative to prior art speakers.

Further, in accordance with another embodiment of the present invention, an acoustically-transparent basket is incorporated which is comprised of ribs having a minimal surface area facing the cone, thereby reducing the magnitude of sound waves reflected from the basket to the cone.

A loudspeaker in accordance with the present invention may also include a motional feedback circuit wherein the motion of the cone and the coil is controlled directly by converting the motion into an electronic signal using a transducer, inverting the signal, and feeding the inverted signal back to a summing point of the control loop.

DESCRIPTION OF THE DRAWINGS

These features, aspects, and advantages of the present invention will become better understood with regard to the following description, appended claims and accompanying drawings, where:

DESCRIPTION OF THE INVENTION

Figure 1A:
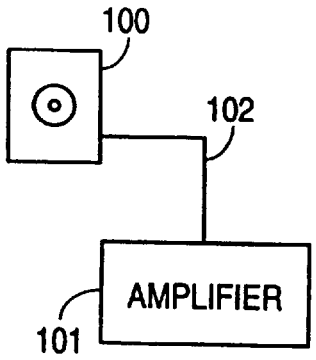
FIG. 1A shows a simplified block diagram of a speaker system incorporating the present invention.

FIG. 1A is a block diagram of a speaker system including a loudspeaker 100 incorporating the present invention and an amplifier 101. The amplifier 101 generates speaker signals which are transmitted to the loudspeaker 100 over speaker wires 102. The amplifier 101 preferably operates in a range of 50 to 200 watts, and more preferably at 100 watts or greater. Herein, an amplifier with this performance capability is referred to as "a high power amplifier." One amplifier suitable for use with the loudspeaker 101 is available from ADCOM under the model number GFA-555.

Figure 1B:
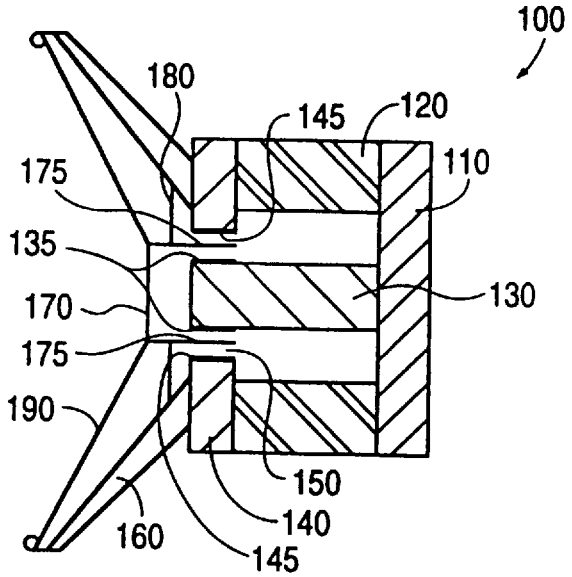
FIG. 1B shows a section view of a loudspeaker incorporating the present invention.
Figure 1C:
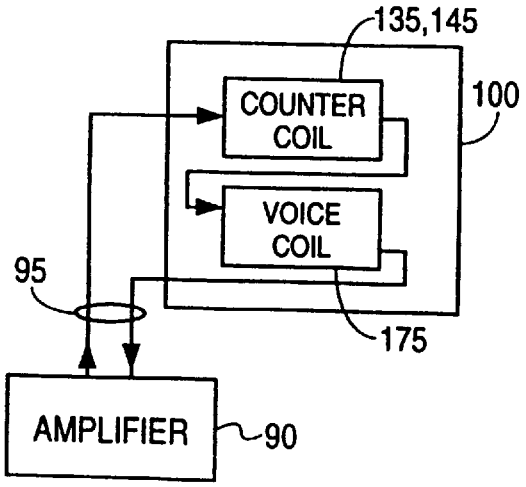
FIG. 1C shows a simplified diagram indicating the wiring connections of the voice coil and the counter coil of the present invention.

FIGS. 1B and 1C show a simplified representation of loudspeaker 100 according to the present invention. The loudspeaker 100 includes a bottom plate 110, a magnet 120, a central pole piece 130, an outer pole piece 140, an air gap 150, a basket 160, a voice coil support 170 upon which is disposed a voice coil 175, a spider 180 and a cone 190. In addition, at least one counter coil 135 and 145 is disposed in the area of the air gap 150 and connected in series with the voice coil 175 such that a first magnetic field generated by the voice coil 175 is eliminated or substantially reduced by a second magnetic field generated by the counter coil. A loudspeaker produced in accordance with the present invention operates without detectable distortion at substantially higher amplitudes than prior art speaker designs.

Also in accordance with the present invention, a stiffened or elongated, or stiffened and elongated voice coil support 170 (herein referred to as a "stiffened/elongated voice coil") is provided. Because the counter coils 135 and 145 are disposed in the air gap 150, the distance between the central pole piece 130 and the outer pole piece 140 is comparably larger than the air gaps commonly employed in prior art loudspeakers. Because of the wider air gap 150, the voice coil bowing effect (as discussed in the background section and incorporated herein by reference) would normally cause an increased amount of distortion over prior art speakers with a narrower air gap. This effect is compensated by the stiffened/elongated voice coil support 170 which provides resistance to and substantially dampens the bowing effect (radial vibrations). However, the increased stiffness and/or elongation causes the voice coil support 170 to have a significantly greater mass than prior art voice coil supports, thereby reducing the sensitivity of the loudspeaker 100. This reduction in sensitivity is compensated by the ability to drive the loudspeaker at higher amplitudes due to the counter coils 135 and 145. The combination of the counter coils 135 and 145 and the stiffened/elongated voice coil support 170 provide a loudspeaker with superior sound qualities over a larger range of sound frequencies than is possible with prior art loudspeakers.

Also, in accordance with the present invention, a method is provided for reducing distortion in an audio system including the steps (a) incorporating a loudspeaker 100 including a counter coil 135, 145 into a speaker system; and (b) driving the speaker system with a high power amplifier 90. A method for adding the counter coil 135, 145 to the loudspeaker (a) disposing the counter coil 135, 145 in an air gap of the loudspeaker and (b) connecting the counter coil 135, 145 in series with the voice coil 175. In this method, the counter coil 135, 145 is wound on the surfaces of the pole pieces 130, 140 in the air gap such that the counter coil 135, 145 generates a first magnetic field which substantially reduces a second magnetic field generated by the voice coil 175.

Also in accordance with the present invention, an acoustically-transparent basket 160 that is, a basket having ribs oriented to minimize sound waves from the cone 190 is provided which presents a minimal acoustic cross-section to the cone 190. The acoustically-transparent basket 160 is comprised of a plurality of ribs having a width disposed perpendicular to the surface of the cone such that only edges of the ribs reflect sound waves produced by the cone. In combination with the counter coils 135 and 155 and the stiffened/elongated voice coil support 170, a loudspeaker incorporating the acoustically-transparent basket 160 provides an even greater reduction in distortion.

Other features and aspects of the present invention are incorporated into the embodiments of the present invention, described below.

Figure 2A:
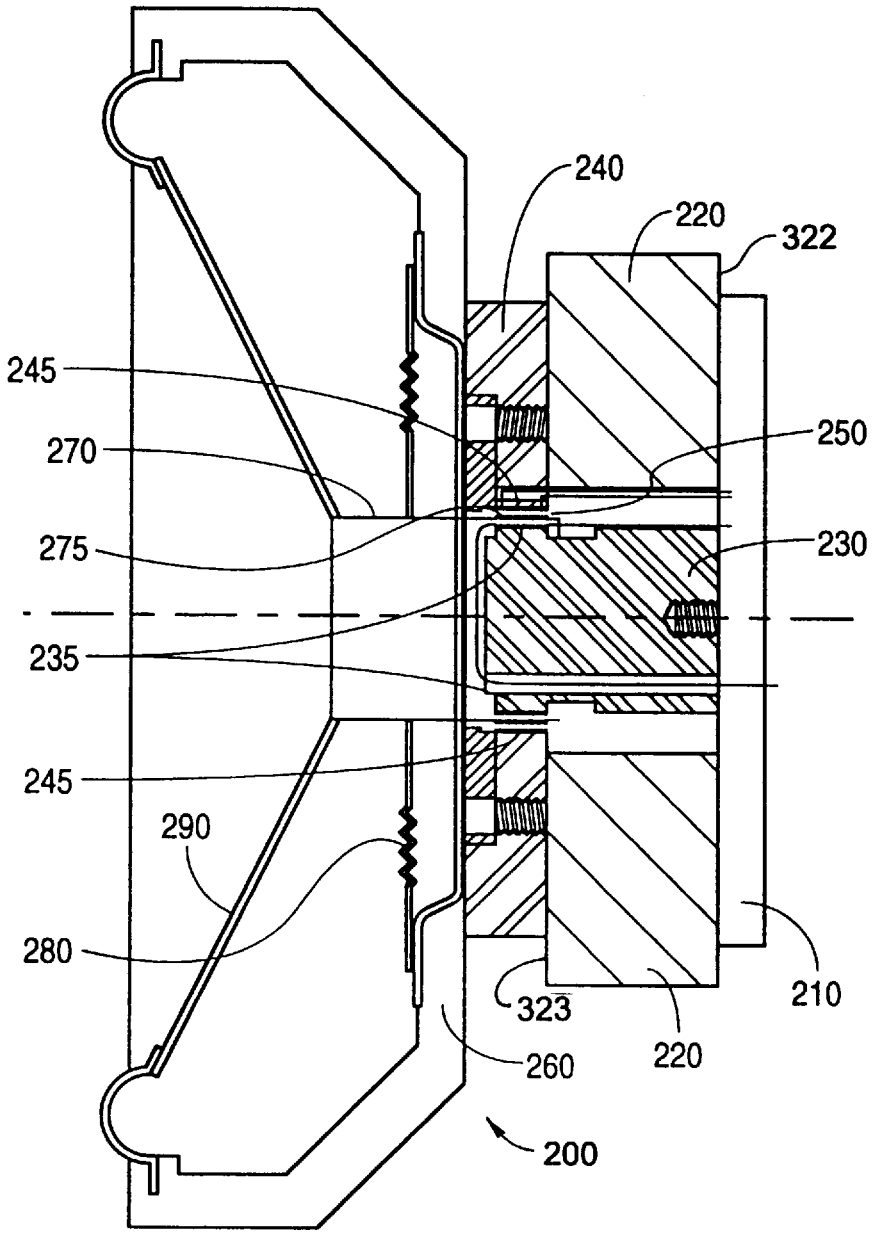
FIGS. 2A and 2B show section side views of loudspeakers according to first and second embodiments of the present invention.

FIG. 2A shows a loudspeaker 200 according to a first embodiment of the present invention. The loudspeaker 200 includes a bottom plate 210, a magnet 220, a central pole piece 230 upon which is disposed a first counter coil 235, an outer pole piece 240 upon which is disposed a second counter coil 245, an air gap 250, a basket 260, a stiffened/elongated voice coil support 270 upon which is fixedly attached a voice coil 275, a spider 280 and a cone 290. Each of the components of the loudspeaker 200 are described in detail below with respect to a midrange 6½ inch loudspeaker. The dimensions provided for the loudspeaker 200 are exemplary, and they can be easily adjusted in view of this disclosure by those of ordinary skill in the art to produce larger or smaller loudspeakers which incorporate features of the present invention.

Figure 2B:
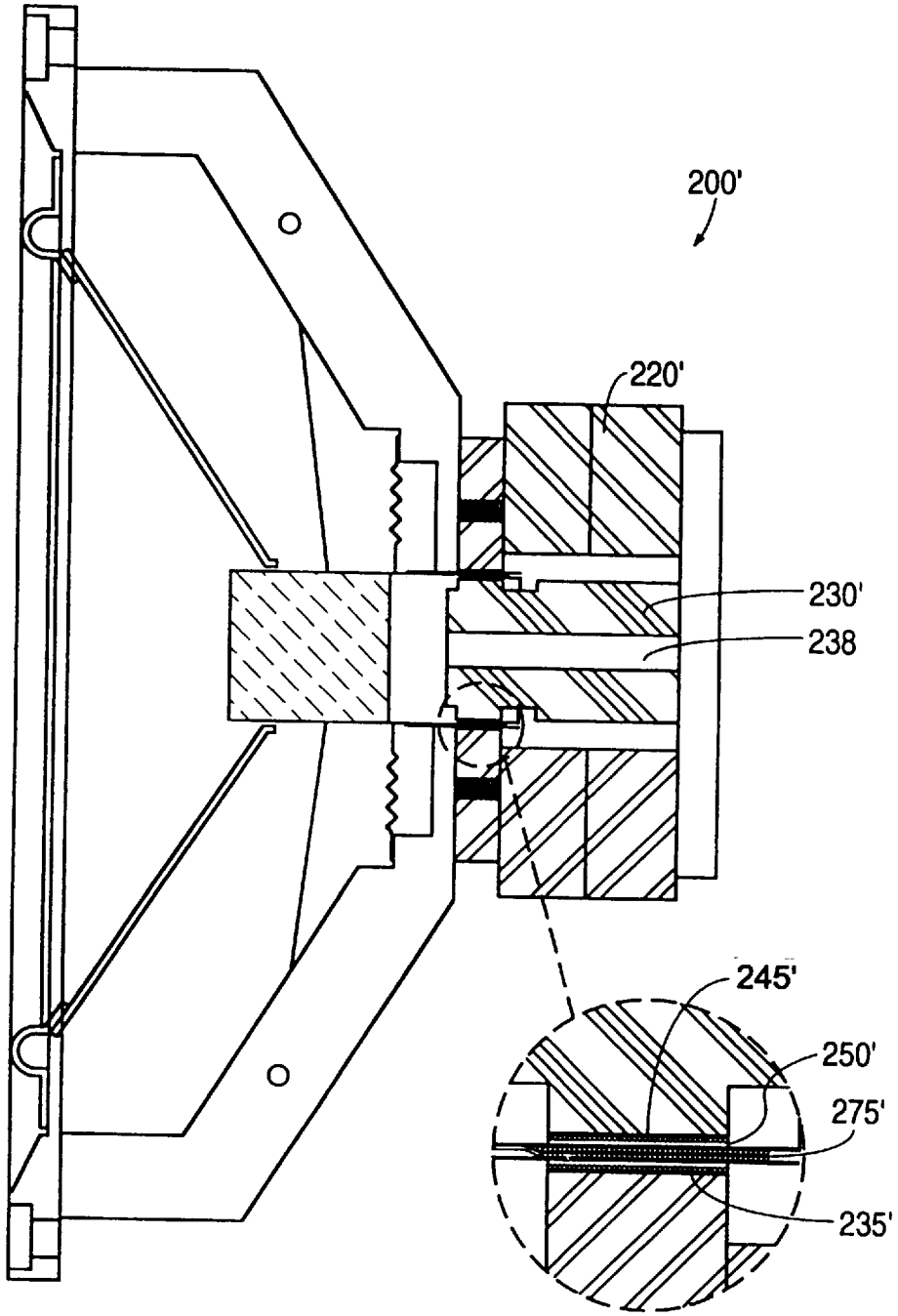

FIG. 2B shows a loudspeaker 200' according to a second embodiment of the present invention. The loudspeaker 200' includes a double-thick magnet 220'. Also shown in FIG. 2B is an enhanced view of the gap area 250' in which are disposed first and second counter coils 235' and 245', and voice coil 275'. Other differences between the first and second embodiments are discussed below.

Referring to FIG. 2A, the bottom plate 210 is a low carbon steel disk having a thickness of 0.25 inches and an outer diameter of 2.95 inches. The bottom plate 210 functions as a base to which the magnet 220 and the central pole piece 230 are concentrically connected.

Figure 3:
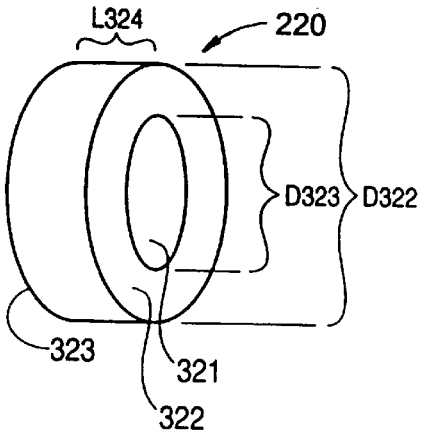
FIG. 3 show a perspective view of a magnet used in the loudspeaker of FIG. 2A.

As shown in FIG. 3, the magnet 220 is formed as a cylinder with the poles of the magnet 220 disposed at each end of the cylinder. The magnet 220 defines a bore (through hole) 321 and has an outer diameter D322 of 3.42 inches and an inner diameter D323 of 1.30 inches. The magnet 220 has a length L324 of 0.850 inches and is concentrically connected at a first end 322 to the bottom plate 210 and at a second end 323 to the outer pole piece 240 by an appropriate adhesive such as epoxy FIG. 2A. The magnet 220 is formed from commonly known magnetic materials. The double-thick magnet 220' (FIG. 2B) incorporates two magnets epoxied together, thereby providing a stronger stationary magnetic field in the air gap 250'.

Figure 4A:
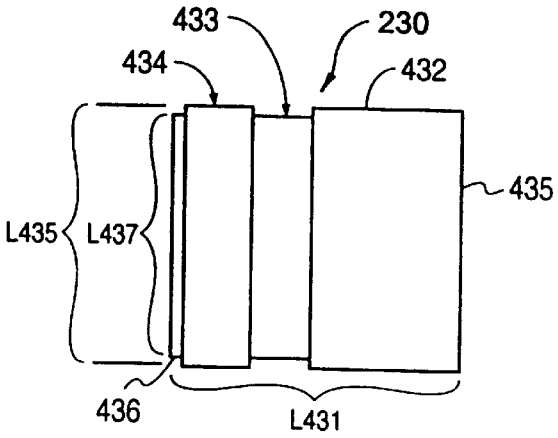
FIGS. 4A through 4C show side, front and section views of a central pole piece used in the loudspeaker of FIG. 2A.
Figure 4B:
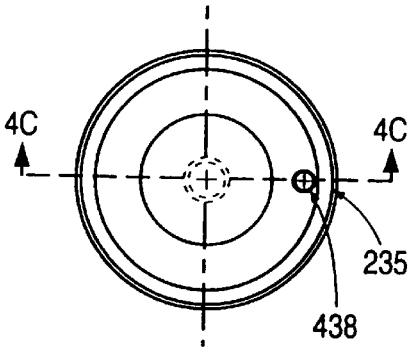
Figure 4C:
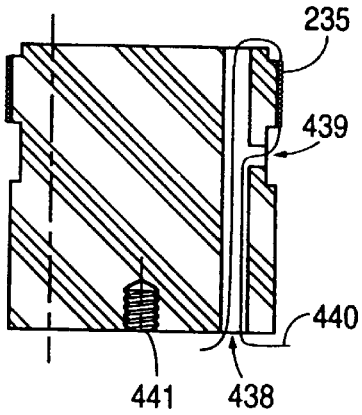

As shown in FIGS. 4A to 4C, the central pole piece 230 is a low carbon steel cylinder having an overall length L431 of 1.175 inches. The central pole piece 230 includes a base portion 432, a groove 433 and a gap portion 434. The groove 433 is formed between the base portion and the gap portion 434. The outer diameter of the base portion 432 is 1.00 inch and the outer diameter L435 of the gap portion 434 is 0.975 inches. The central pole piece 230 also includes a ridge 436 formed adjacent the gap portion 434. The diameter L437 of the groove 433 and the ridge 436 is 0.880 inches. The length of the base portion 432 is 0.60 inches. The length of the groove 433 is 0.25 inches and the length of the gap portion 434 is 0.280 inches. The groove 433 and the ridge 436 function to reduce warping of the stationary magnetic field caused by increasing the distance between the surfaces of the pole pieces 230, 240 at the edges of the air gap 250 FIG. 2A.

As shown in FIGS. 4B and 4C, a first counter coil 235 is disposed around the gap portion 434 of the central pole piece 230. The first counter coil 235 is formed by wrapping 25 turns of 30 AWG copper wire around the gap portion 434. A first hole 438 is formed extending through and along the length of the central pole piece 230 and a second hole 439 is formed connecting the bottom surface of groove 433 to the first hole 438. As shown in FIG. 4C, the first and second holes 438 and 439 provide a conduit for lead wires 440, which transmit speaker signals to the first counter coil 235. The central pole piece 230 is connected to the bottom plate 210 using a fastener, such as a screw, which is inserted into threaded third hole 441.

Referring briefly to FIG. 2B, a central pole piece 230' according to a second embodiment, includes a centrally located through-hole 238 through which leads are connected to the first counter coil 235'.

Figure 5A:
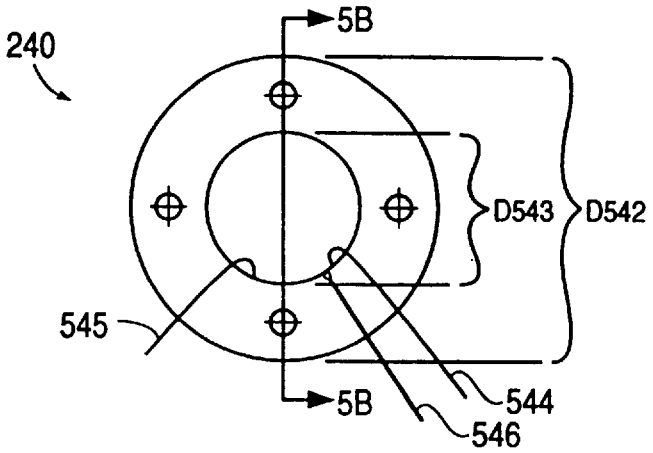
FIGS. 5A and 5B show front and side views of an outer pole piece used in the loudspeaker of FIG. 2A.
Figure 5B:
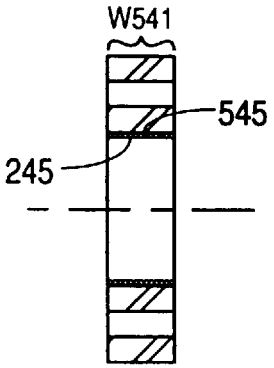

As shown in FIGS. 5A and 5B, the outer pole piece 240 is a low carbon steel disk having a width W541 of 0.281 inches, an outer diameter D542 of 2.95 inches, and an inner diameter D543 of 1.127 inches. A ledge 544 is formed on the inner surface 545 of the outer pole piece 240 and a through hole 546 is formed in the ledge for connecting leads 547 to the second counter coil 245. The second counter coil 245 is a 30 AWG copper wire wrapped in 25 turns and connected to the inner surface 545 by a suitable adhesive. The outer pole piece 240 is concentrically connected to the second end 323 (see FIG. 3) of the magnet 220 using an adhesive such that the air gap 250 (see FIG. 2A) is formed between an inner surface 545 of the outer pole piece 240 and the gap portion 434 (see FIG. 4A) of the central pole piece 230.

Figure 6B:
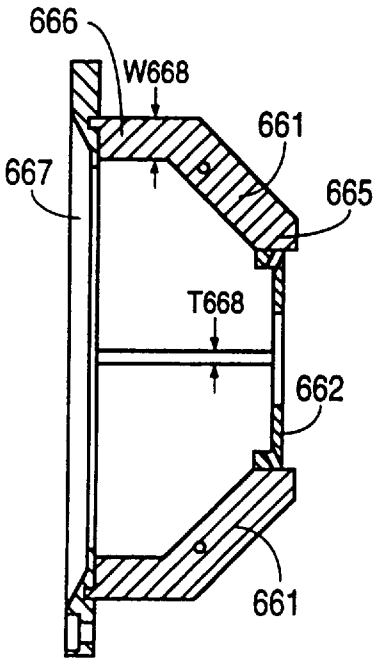
FIGS. 6A and 6B show front and side views of a basket used in the loudspeakers of FIGS. 2A and 2B.
Figure 6A:
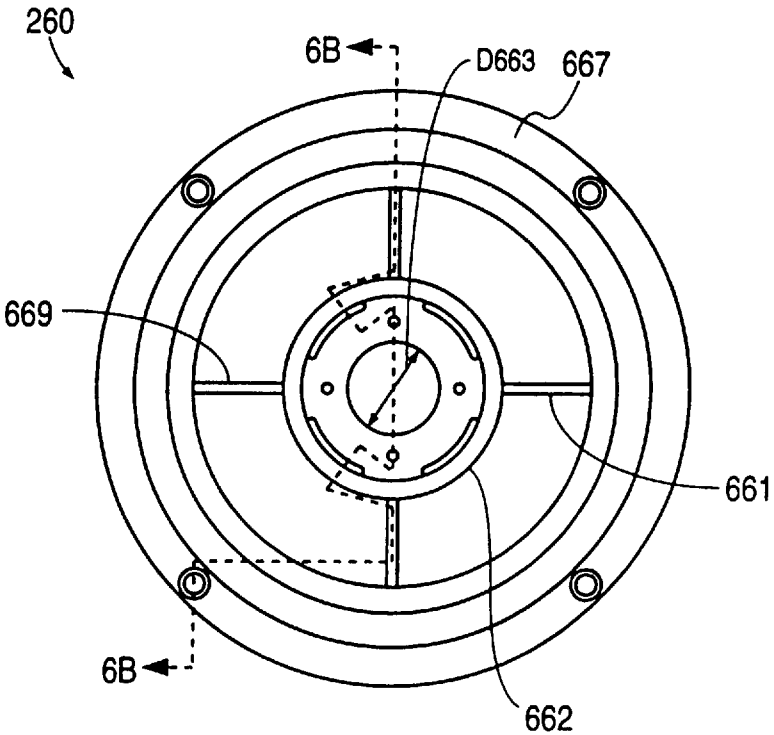

As shown in FIGS. 6A and 6B, the acoustically-transparent basket 260 in accordance with the present invention includes a plurality of support ribs 661 where the smallest cross section of each rib faces the cone 290. Thus, the larger cross section of said rib is perpendicular to cone 290. Thus configuration of the ribs is exactly the opposite to prior art rib configurations. Therefore, relative to this prior art rib configuration, the ribs of this invention reflect a significantly smaller amount of the sound waves and so basket 260 is effectively transported to the sound waves.

The basket 260 is die-cast aluminum including a central ring 662 which is concentrically connected to the outer pole piece 240. The central ring 662 has an inner diameter D663 sized to fit around the air gap 250. Each rib 661 has a first end 665 connected to the central ring 662 and a second end 666 connected to a connecting ring 667. The ribs 661 have a thickness T668 of ⅛ inches and have a width W668 of approximately ½ inches at the narrowest point. The ribs 661 are connected to the central ring 662 and the connecting ring 667 such that the minimum cross section area of each rib 661 (in the present embodiment, an edge 669 having a thickness T668) is disposed toward the surface of the cone 290. The width W668 of the ribs 661 can be varied so long as the width is disposed perpendicular to the cone 290. Finally, the connecting ring 667 is formed using known techniques and has an outer diameter of about 7½ inches.

As shown in FIGS. 7A to 7J, the voice coil support 270 formed in accordance with the present invention includes a first cylindrical wall 771 and a voice coil 275 disposed on an outer surface of the first wall 771 adjacent to but separated from a first end 772. The voice coil support 270 is connected at a second end 773 to the cone 290. The first wall 771 is a carbon fiber or fiberglass sheet 5 mils thick which is formed into a cylinder having a diameter D774 of 1.20 inch and a length L775 of 2.00 inches. The voice coil 275 is a 30 AWG copper wire double-wrapped in 60 turns and connected to the outer surface of the first wall 771 by a suitable adhesive. Leads 776 are disposed on the outer surface of the first wall 771 and extend from the voice coil 275 in the direction of the second end 773. A second cylindrical wall 780 is formed over the voice coil 275.

Figure 7A:
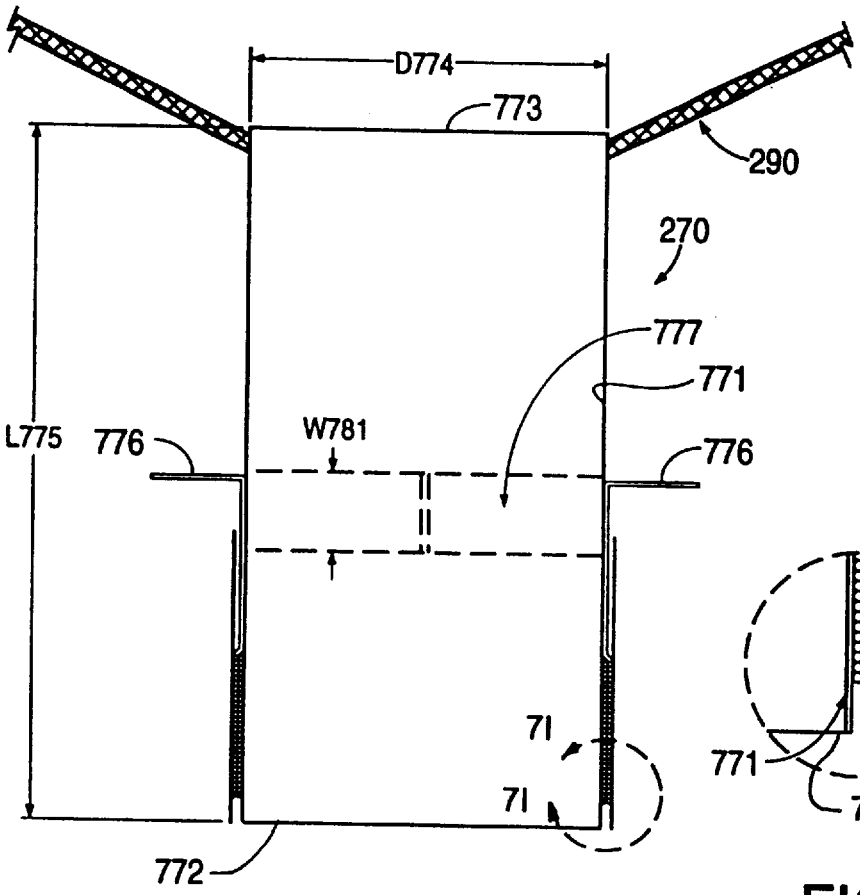
FIGS. 7A and 7B show front and section views of a voice coil support according to a first embodiment of the present invention.
Figure 7I:
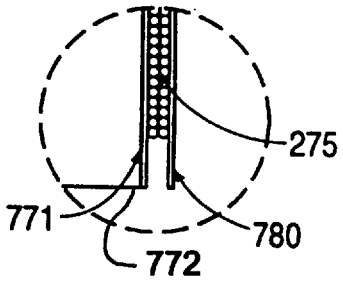
FIGS. 7E through 7J are front and section views of a voice coil support according to a third embodiment of the present invention.
Figure 7B:
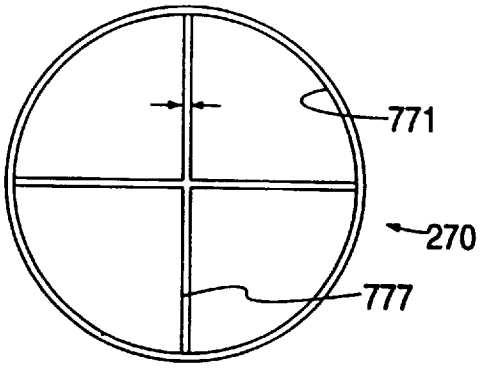

As shown in FIGS. 7A and 7B, cross-braces 777 are formed in the interior of the voice coil support 270. The cross-braces 777 are added to stiffen the voice coil support 270 to resist distortion due to the voice coil bowing effect. The cross braces 777 are formed of carbon fiber or fiberglass strips 10 mils thick and have a width W781 of 0.25 inches. The cross braces 777 are connected in an X-shaped pattern within the voice coil support 270 using a suitable adhesive.

It has been observed that the damping effect of the stiffened/elongated voice coil support 270 is maximized when the ratio of the diameter D772 to the length L773 is unity or less. It other words, it is presently preferred that the ratio of length L773 to diameter 0772 be in the range of 1:2 and 1:3, and most preferably approximately 1:2. Of course, the diameter-to-length ratio can be closer to 1:3 provided the voice coil support 270 is sufficiently stiff.

Figure 7C:
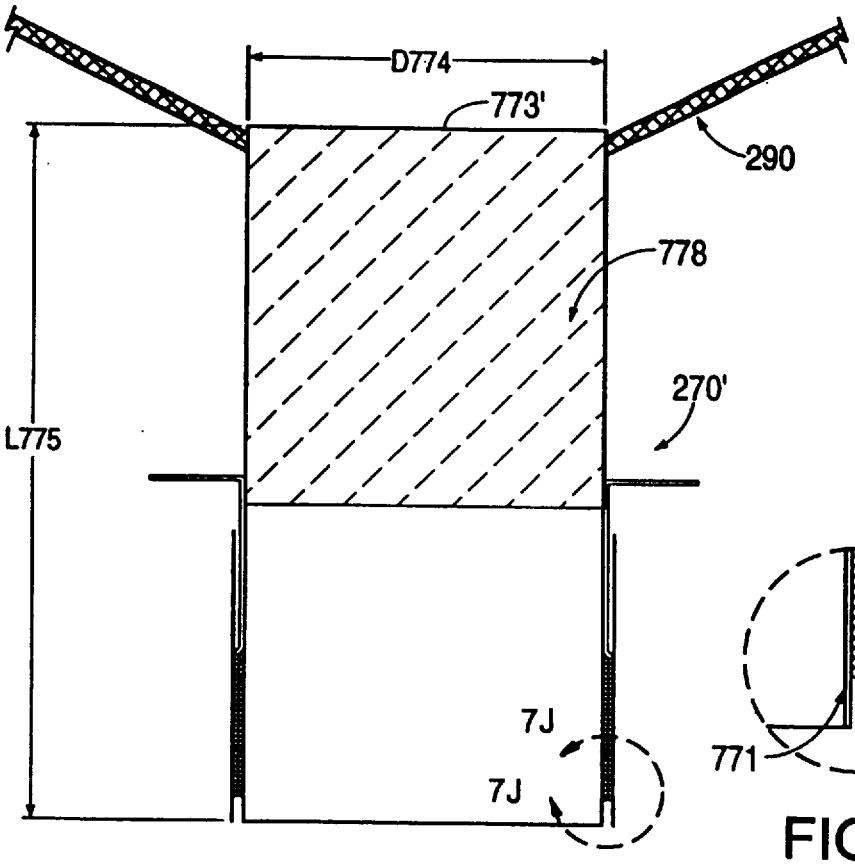
FIGS. 7C and 7D show front and section views of a voice coil support according to a second embodiment of the present invention.
Figure 7J:
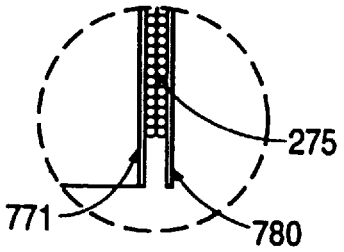
Figure 7D:
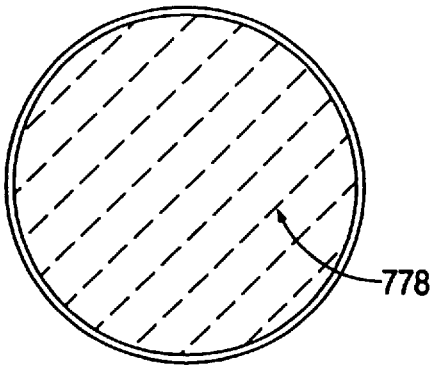
Figure 7F:
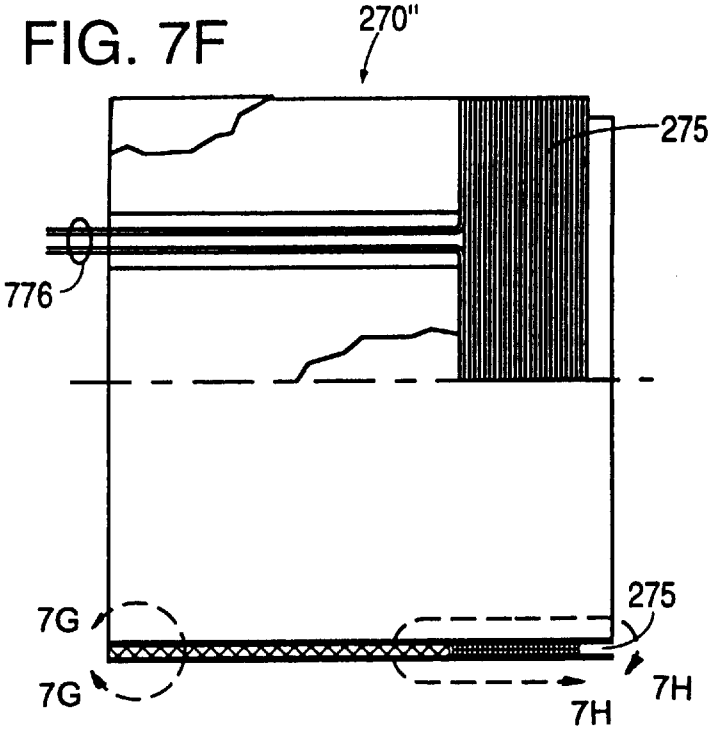
Figure 7E:
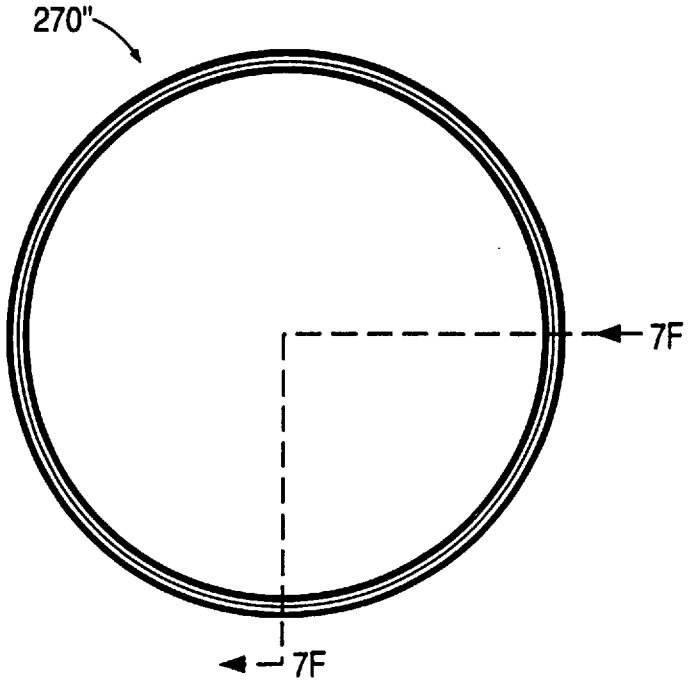
Figure 7H:
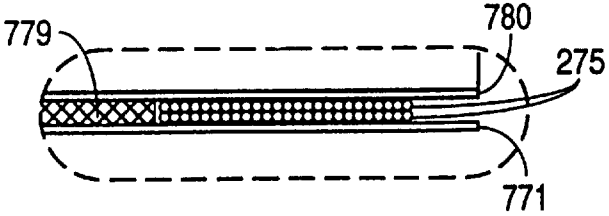
Figure 7G:
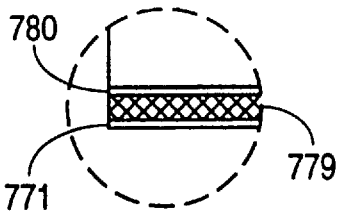

As shown in FIGS. 7C and 7D, a stiffened/elongated voice coil support 270' according to a second embodiment includes a foam plug 778 injected into the interior of the voice coil support 270 adjacent the second end 773' and extending to, at most, to the windings of the voice coil 275. The foam plug 778 can be styrofoam or any other suitable foam material. In addition, the foam plug 778 can be formed in combination with the cross-braces 777, discussed above.

As shown in FIGS. 7E–7J, voice coil support 270" in accordance with a third embodiment includes forming a laminate structure on the first wall 771 comprising an inner layer 779 and an outer wall 780. The inner layer 779 can be made of balsa wood which is cut into strips, soaked, and adhered to the first wall 771 by means of adhesive. The inner layer 779 can also be formed from plastic. The outer wall 780 can be formed of carbon fiber or fiberglass and connected to the inner layer 779 by adhesive.

Referring again to FIG. 2A, the spider 280 and the cone 290 are connected to the voice coil support 270 and to the basket 260 using known techniques.

Figure 8A:
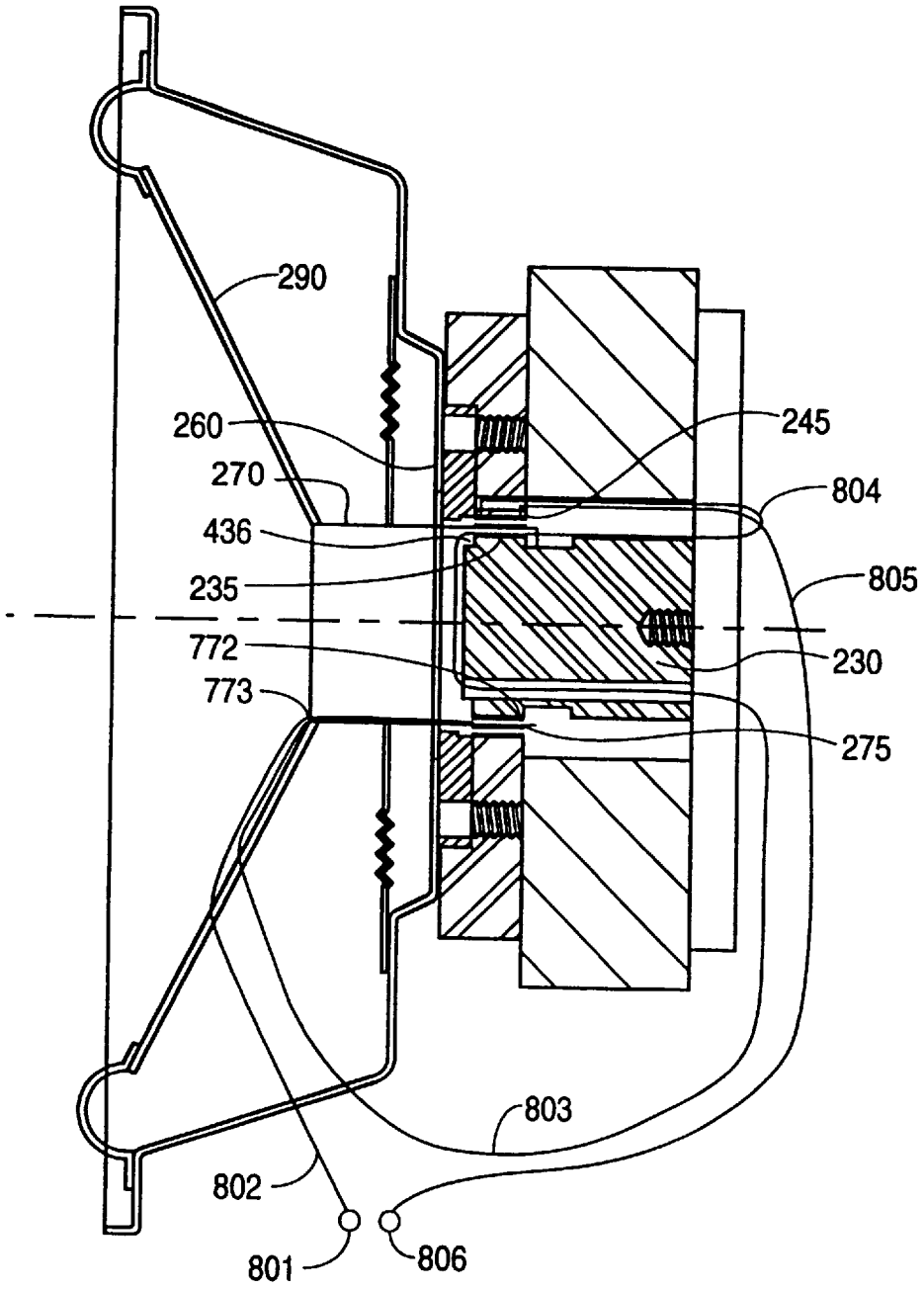
FIG. 8A shows a section view of a loudspeaker indicating the wiring connections of the voice coil and counter coils.
Figure 8B:
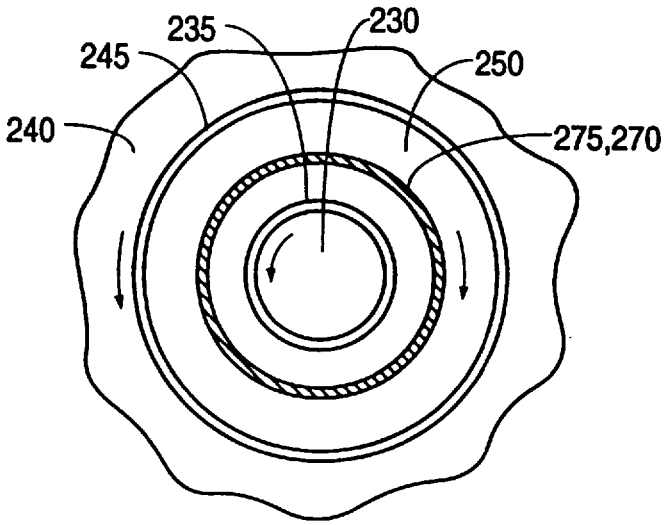
FIGS. 8B and 8C partial end views of a loudspeaker indicating the wire wrapping directions of the voice coil and counter coils.
Figure 8C:
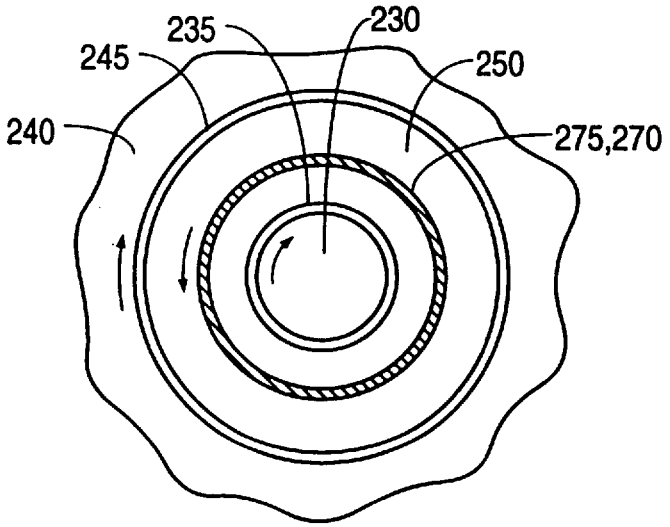

FIG. 8A through 8C indicate a method for reducing distortion in an air gap of a loudspeaker in accordance with the present invention. FIG. 8A shows the wiring connections associated with the voice coil 275 and the first and second counter coils 235 and 245. As indicated, a speaker terminal 801 is connected to a first lead 802 which passes through the cone 290 to end 773 of the voice coil support 270. The first lead 802 extends from end 773 to the double-wrapped voice coil 275 and is connected to voice coil 275 at a point of voice coil 275 closest to the end 773. Note that both windings of the double-wrapped voice coil 275 are wired such that current passes through both windings in a common first direction (e.g., clockwise). A second lead 803 is connected to the voice coil 275 near the end 772 and is lead back through the cone 290 and into the first hole 438 formed in the central pole piece 230. The second lead 803 is connected to a first end of the first counter coil 235 which is disposed adjacent the ridge 436 formed on the central pole piece 230. A third lead 804 is connected between a second end of the first counter coil 235 adjacent the groove 433 and a first end of the second counter coil 245 disposed closest to the basket 260. A fourth lead 805 is connected to a second end of the second counter coil 245 and is lead to a second speaker terminal 806. Note that a current travels along the voice coil 275 and the first and second counter coils 235 and 245 in a second direction (e.g. counterclockwise) which is opposite to the first direction.

FIGS. 8B and 8C show two methods for winding the first counter coil 235, second counter coil 245 and voice coil 275 such that the magnetic field generated by the voice coil 275 is reduced in the air gap 250. FIG. 8B shows a front view indicating a first method in which the voice coil 275 (both layers) is wound in a clockwise direction on the voice coil support 270, and the first counter coil 235 and second counter coil 245 are wound in a counter-clockwise direction on the central pole piece 230 and the outer pole piece 240, respectively. FIG. 8C shows a second method in which the voice coil 275 is wound in a counter-clockwise direction, and the first counter coil 235 and second counter coil 245 are wound in a clockwise direction. Note that the winding direction of the voice coil 275 must be opposite to the winding direction of the first counter coil 235 and second counter coil 245 for the first magnetic field generated by the voice coil 275 to be reduced by the second magnetic field generated by the first and second counter coils 235 and 245.

Figure 9:
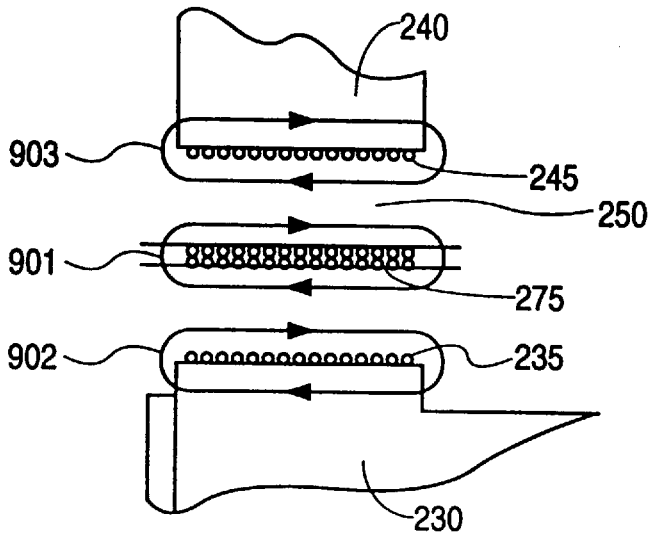
FIG. 9 shows an enlarged section view showing the magnetic fields generated in the air gap according to the present invention.

As shown in FIG. 9, with the first counter coil 235, second counter coil 245 and the voice coil 275 wired in series as described immediately above, a speaker signal applied to the terminals 801 and 806 (see FIG. 8) causes a first current to flow in the coils. The current in the voice coil 275 generates a first magnetic field around the voice coil 275, indicated by flux line 901. Similarly the current in the first and second counter coils 235 and 245 generates second and third magnetic fields indicated by flux lines 902 and 903. The current travels in the counter coils 235 and 245 in the opposite direction to the current in the voice coil 275, and so the first and second magnetic fields have opposite senses in the air gap 250. Therefore, the first magnetic field generated by the voice coil 275 is reduced by the second magnetic field generated by the first and second counter coils 235 and 245. Therefore, there is little or no weakening of the stationary magnetic field across the air gap 250, and therefore the driving force acting on the voice coil 275 is not modulated as in the prior art. Of course, when current flows in a second direction opposite to the first direction, the magnetic fields around the voice coil 275 and the first and second counter coils 235 and 245 are reversed, but the counter coil magnetic fields continue to cancel the voice coil magnetic field.

A benefit of the counter coil structure discussed above is that speaker signals applied to the voice coil 275 can be substantially greater than signals applied to prior art speakers of comparable size without creating distortion caused by the weakening of the stationary magnetic field. It has been determined that the cancellation of the magnetic field generated by the voice coil 275 is maximized when the voice coil 275 and the first and second counter coils 235 and 245 are wound with the same spacing between adjacent coils.

It has been observed that a loudspeaker incorporating the first and second counter coils 235 and 245 can be driven at higher amplitudes without modulation of the voice coil driving force. However, distortion due to the bowing effect of the voice coil 275 becomes significant even at lower power levels. To counter the bowing effect, the stiffer/elongated voice coil supports, described above, are employed to resist and to dampen the distortion caused by bowing of the voice coil. Although the use of the stiffer/elongated voice coil supports reduces the sensitivity of a loudspeaker due to their greater mass, the loss of sensitivity is compensated by increased signal amplitude allowed by the counter coil structure. Incorporation of both the stiffened/elongated voice coil support 270 and the counter coil structure into a loudspeaker provides a substantial improvement over prior art loudspeakers.

Motional Feedback Circuit

In addition to the features discussed above, a loudspeaker according to the present invention may also include a motional feedback circuit wherein the acceleration of the cone and the coil is detected by a transducer which outputs an associated signal, the signal is then inverted, and the inverted signal is fed back to a summing point of a control loop. A motional feedback systems is described in U.S. Pat. No. 4,573,189 to Hall, "Loudspeaker With High Frequency Motional Feedback", which is incorporated herein by reference.

Figure 10:
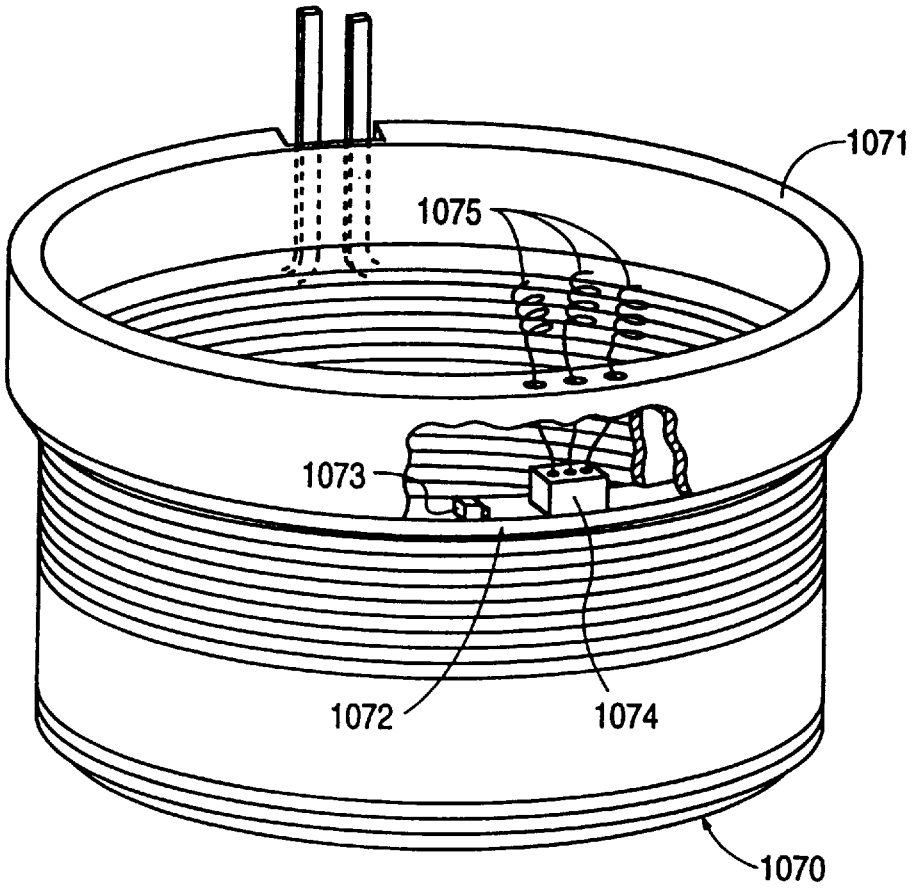
FIG. 10 shows a perspective view of a motional feedback system according to an embodiment of the present invention.

FIG. 10 illustrates a perspective view of voice-coil support 1070 broken away to show the components of the motional feedback system. Voice-coil support 1070 carries a conductive shield ring 1071 having a cross-section in the form of an inverted U-shape and which surrounds a tiny transducer in the form of a motion-sensing element 1072, specifically comprising an accelerometer 1073, an associated charge amplifier 1074 and output leads 1075. In one embodiment, the frequency at which the open-loop gain of the motional feedback circuit is in excess of unity, and associated open-loop phase angle is less than 180°, is at least about 1000 Hz, and preferably well in excess of this figure. Thus, it is desirable that motional feedback be used to directly control the motion of voice-coil unit 1070 in addition to the various other features discussed above.

Figure 11A:
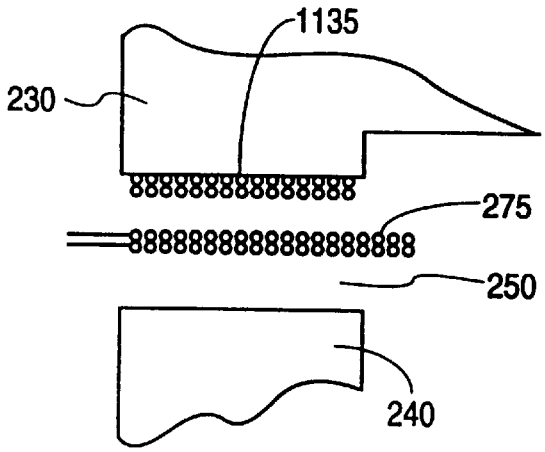
FIGS. 11A through 11C show section views indicating alternative placements of the counter coils.
Figure 11B:
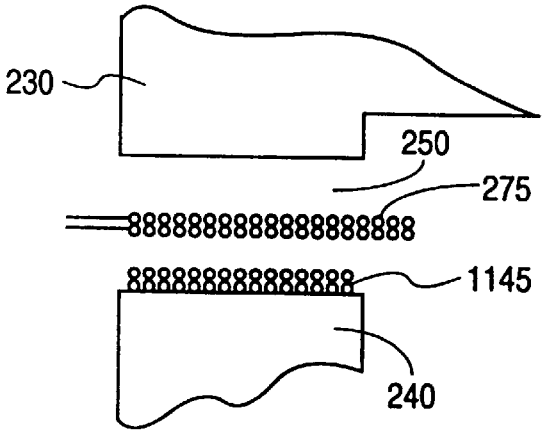
Figure 11C:
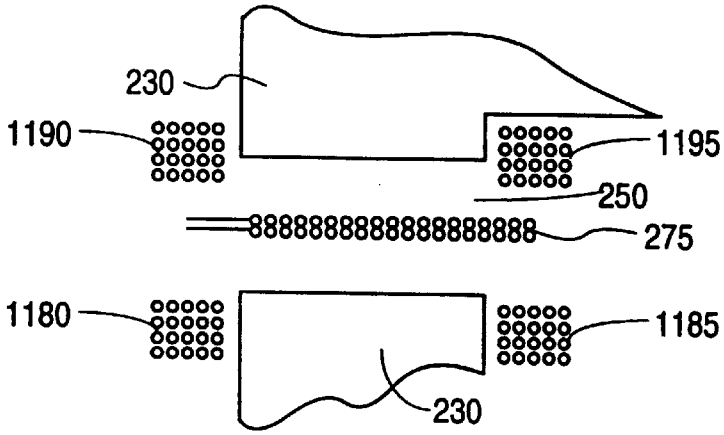
Figure 12A:
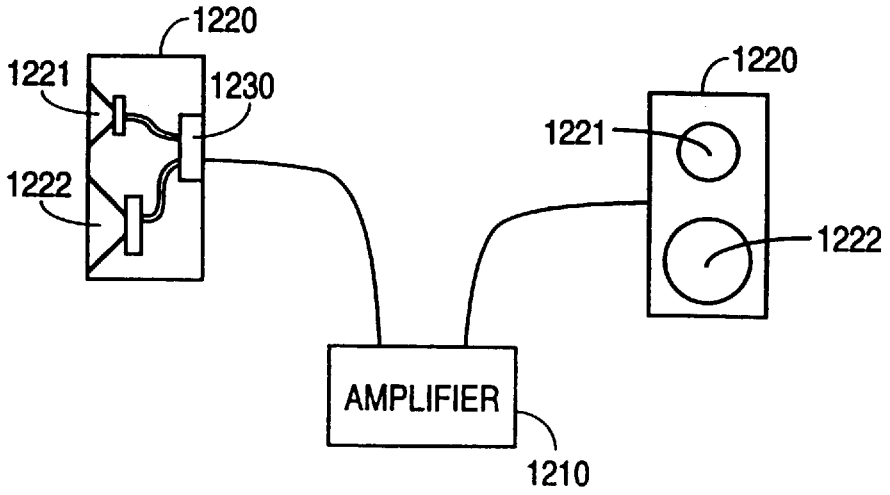
FIG. 12A (PRIOR ART)
FIG. 12A shows a block diagram of a prior art two-way speaker system.
Figure 12B:
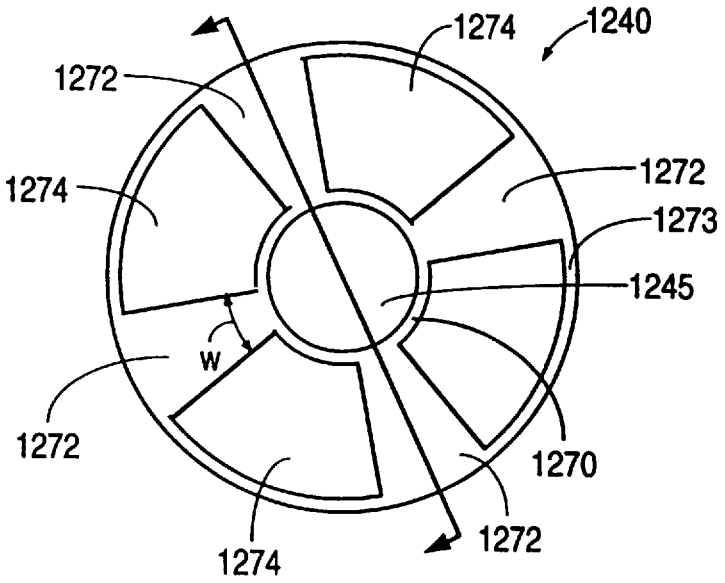
FIGS. 12B and 12C show back and section views of a prior art loudspeaker.
Figure 12C:
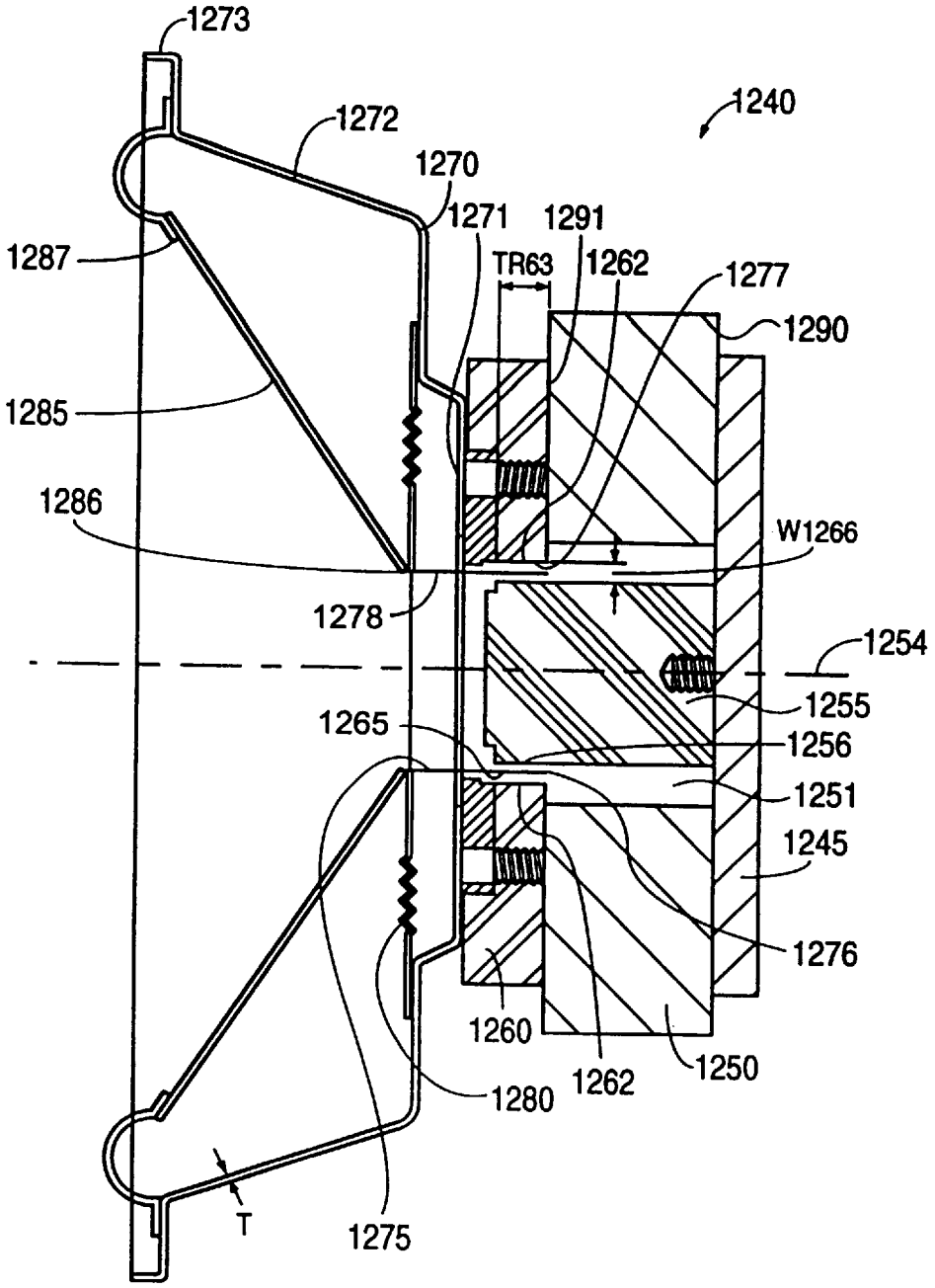
FIG. 12C (PRIOR ART)
Figure 13A:
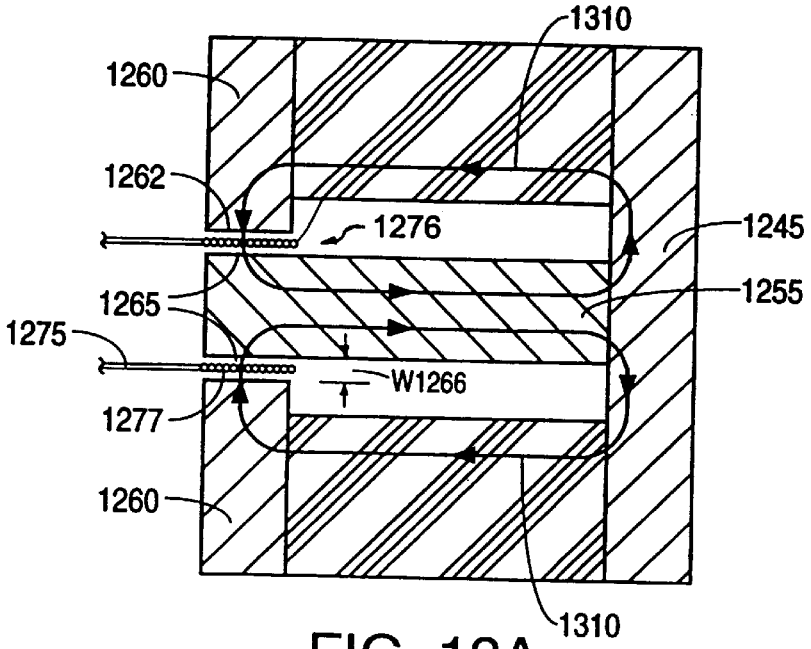
FIG. 13A (PRIOR ART)
FIGS. 13A through 13C show section views indicating magnetic fields in the air gap of the prior art loudspeaker.
Figure 13B:
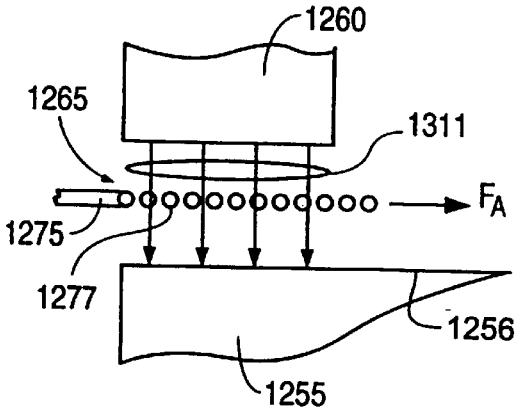
FIG. 13B (PRIOR ART)
Figure 13C:
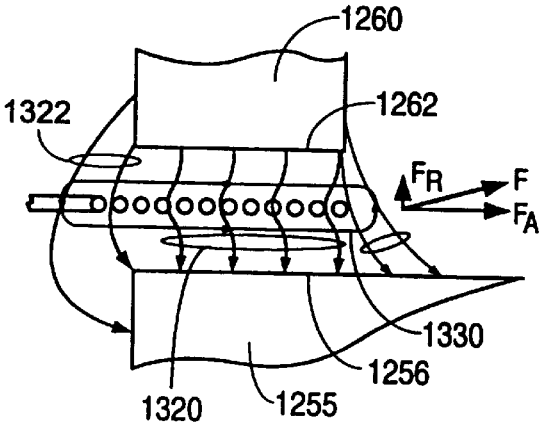
FIG. 13C (PRIOR ART)
Figure 14:
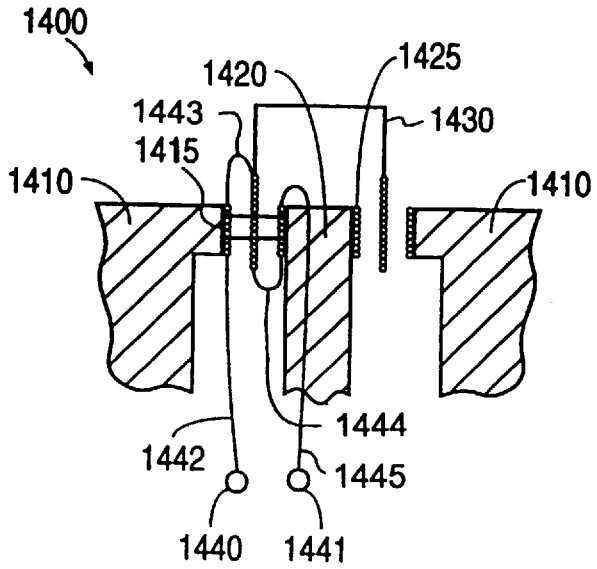
FIG. 14 (PRIOR ART)
FIG. 14 shows a wiring pattern of a prior art fixed coil.

The description of the embodiments of this invention is intended to be illustrative and not limiting. Numerous other embodiments will be apparent to those skilled in the art, all of which are included within the broad scope of this invention. For example, a double-layer counter coil 1135 can be located on the central pole piece 230, as shown in FIG. 11A, or a double-layer counter coil 1145 can be located on the outer pole piece 240, as shown in FIG. 11B. In either of these embodiments, the number of windings per inch of air gap length should be the same for both the voice coil and the counter coil. Further, as shown in FIG. 11C, counter coils 1180, 1185, 1190 and 1195, wired in accordance with the present invention, can be disposed adjacent the edges of the air gap. Moreover, it is also possible for the number of windings of the counter coils per inch of air gap to be different from the number of windings per inch of the voice coil provided the signal fed to the counter coil can be increased or decreased accordingly such that the magnetic field generated by the voice coil is substantially canceled. Finally, the materials in this invention are not limited to those discussed in reference to the above-described embodiments. For example, the counter coils could be made of aluminum or any other suitable wire material.

What is claimed is:

1. A loudspeaker system having a sound cone driven by an amplifier producing an input signal comprising:

a. a magnet;

b. a support, said support disposed in the vicinity of said magnet and including a voice coil generating a first magnetic field of a certain magnitude in response to said input signal, said support being elongated along a dimension, said support being connected to the sound producing cone at one end thereof, said support further including stiffening means to substantially lessen bowing of said support and said voice coil along said dimension, said stiffening means including a stiff, non-flexible, cross brace spanning an inner wall of said support;

c. a first pole piece disposed in the vicinity of said magnet, said first pole piece including a first counter coil generating a second magnetic field of a certain magnitude in response to said input signal;

d. a second pole piece disposed in the vicinity of said magnet, said second pole piece at least partially surrounding said first pole piece forming a gap therebetween said second pole piece including a second counter coil generating a third magnetic field of a certain magnitude in response to said input signal, said voice coil being disposed between said first and second counter coils in said gap, said second and third magnetic fields interacting with said first magnetic field to produce a resultant magnetic field lower in magnitude than said first magnetic field.

2. A loudspeaker system having a sound cone driven by an amplifier producing an input signal comprising:

a. a magnet;

b. a support, said support disposed in the vicinity of said magnet and including a voice coil generating a first magnetic field of a certain magnitude in response to said input signal, said support being elongated along a dimension, said support being connected to the sound producing cone at one end thereof, said support further including stiffening means to substantially lessen bowing of said support and said voice coil along said dimension, said stiffening means including a stiff non-flexible plug spanning an inner wall of said voice coil support;

c. a first pole piece disposed in the vicinity of said magnet, said first pole piece including a first counter coil generating a second magnetic field of a certain magnitude in response to said input signal;

d. a second pole piece disposed in the vicinity of said magnet, said second pole piece at least partially surrounding said first pole piece forming a gap therebetween said second pole piece including a second counter coil generating a third magnetic field of a certain magnitude in response to said input signal, said voice coil being disposed between said first and second counter coils in said gap, said second and third magnetic fields interacting with said first magnetic field to produce a resultant magnetic field lower in magnitude than said first magnetic field.

3. The speaker system of claim 2 in which said voice coil support is cylindrical and said dimension is the altitude of a cylinder.

4. The loudspeaker of claim 2 in which said stiffening means further includes laminated layers formed on said voice coil support.

5. The loudspeaker system of claim 2 in which the voice coil is oriented in a first direction and said first counter coil is oriented in a second direction opposite to said first direction.

6. The loudspeaker system of claim 2 which further comprises a motional feedback circuit comprising:

a. a motional transducer element secured to said voice coil support, said motion transducer producing a transducer signal;

b. negative feedback means coupled to said transducer to combine said transducer signal with said input signal to form a closed feedback loop, the amplifier having its input coupled to the composite of transducer and audio signals of said sound producing cone, the output of said amplifier being transmitted to drive said voice coil.

7. The speaker system of claim 3 in which said plug is composed of a foam plastic material.

* * * * *